US005796013A

United States Patent [19]

Nagata et al.

[11] Patent Number: 5,796,013

[45] Date of Patent: Aug. 18, 1998

[54] TORSION DETECTION APPARATUS FOR POWER TRANSMISSION SHAFT AND POWER TRANSMISSION APPARATUS

[76] Inventors: Toshio Nagata, 24-2, 4-chome Minamiaoyama, Minato-ku; Jinichi Akayama, 501, 3-51-13, Eifuku, Suginami-ku, both of Tokyo, Japan

[21] Appl. No.: 820,572

[22] Filed: Mar. 19, 1997

[30] Foreign Application Priority Data

Sep. 17, 1996 [JP] Japan ..... 8-265078

[51] Int. Cl.[6] ..... G01L 3/02; G01L 3/10

[52] U.S. Cl. ..... 73/862.325

[58] Field of Search ..... 73/862.191, 862.322, 73/862.325, 862.326, 862.194, 862.195, 862.328, 862.329

[56] References Cited

U.S. PATENT DOCUMENTS

| | | | |
|---|---|---|---|
| 3,295,367 | 1/1967 | Rundell | 73/862.326 |
| 3,545,265 | 12/1970 | McIraith et al. | 73/862.326 |
| 4,509,375 | 4/1985 | Davis | 73/862.322 |
| 4,682,505 | 7/1987 | Morissette et al. | 73/862.328 |
| 4,920,788 | 5/1990 | Ando et al. | 73/118.1 |
| 4,967,858 | 11/1990 | Kotake et al. | 73/862.325 X |
| 5,020,616 | 6/1991 | Yagi et al. | 73/862.325 X |
| 5,031,455 | 7/1991 | Cline | 73/862.328 X |
| 5,065,633 | 11/1991 | Mercat | 73/862.326 |
| 5,195,383 | 3/1993 | Tanaka et al. | 73/862.826 X |

FOREIGN PATENT DOCUMENTS 3006598 11/1994 Japan .

*Primary Examiner*—William L. Oen

*Attorney, Agent, or Firm*—Graybeal Jackson Haley LLP

[57] ABSTRACT

The invention provides a power transmission apparatus which includes a power transmission shaft having a pair of universal joints provided at the opposite ends thereof, and a torsion detection apparatus for detecting a torsion of the power transmission shaft when the power transmission shaft is acted upon by a rotating force. The torsion detection apparatus includes a pair of rotatable members mounted on the power transmission shaft for rotation together with the power transmission shaft and a detection means. The rotatable members have at least one pair of opposing portions which are opposed to each other in a spaced relationship from each other around the power transmission shaft, and the detection means includes a sensor mounted on one of the opposing portions of the rotatable members for detecting an approach of the other opposing portion to the one opposing portion.

8 Claims, 4 Drawing Sheets

TORSION DETECTION APPARATUS FOR POWER TRANSMISSION SHAFT AND POWER TRANSMISSION APPARATUS

BACKGROUND OF THE INVENTION

This invention relates to a power transmission apparatus including a power transmission shaft for transmitting power of a driving source to a driven apparatus such as, for example, a roller leveler which is a surface flattening apparatus for a rolled strip and also to an apparatus for detecting a torsion of the power transmission shaft.

A roller leveler includes upper and lower sets of work rolls which define therebetween a pass line along which a rolled strip is passed. Each work roll of the upper and lower work roll sets receives rotating power from a motor located outside the roller leveler and serving as a driving source via a power distributing gear mechanism or the like connected to the motor, and is rotated around an axial line thereof. The rotating power of the driving source is transmitted to each work roll via a power transmission apparatus interposed between the power distributing gear mechanism and each work roll. The strip receives the rotating force of the work rolls and is moved along the pass line, and during the movement, it receives a pressing down force acting from the upper work roll set toward the lower work roll set, so that any strain of the surfaces thereof is removed to thereby make the surfaces of the strip flat.

The conventional power transmission apparatus mentioned above includes a power transmission shaft having a pair of universal joints provided at the opposite ends thereof. The universal joints of the power transmission shafts are connected to corresponding drive shaft of the power distributing gear mechanism and corresponding ones of the work rolls.

By the way, the magnitude of the pressing down force acting upon the strip on the pass line is set, taking the thickness of the strip, a strain position of each surface, a degree of the strain amount and some other parameter into consideration. However, during the flattening operation for the strip, the contacting pressure between one of the work rolls and the strip sometimes increases abnormally to such a degree that one of the universal joints connected to the work roll is acted upon and broken by an excessive load higher than a designed allowable torque level.

A possible countermeasure to prevent such breakage is, for example, to use a universal joint of a large size. However, a distance between the power transmission shafts extending from the corresponding work roll sets is so short that it is actually difficult to employ universal joints of a large size as the universal joints to be connected to the work rolls.

Thus, another countermeasure is proposed, for example, in Japanese Utility Model Registration No. 3,006,598 wherein a portion of a power transmission shaft which is connected to a universal joint on the driving side is formed from a pair of mutually mating parts and a plurality of pins are provided so as to extend in axial directions thereof through the two parts. With the countermeasure just described, if torque of an excessively high level acts upon the power transmission shaft, then the pins are broken to interrupt the connection between the two parts of the power transmission shaft. As a result, the universal joint does not undergo the overload, and breakage thereof is prevented.

The countermeasure, however, has a problem in that, when the power transmission shaft is released from its restriction and is whirled, the portion of the power transmission shaft swings about and breaks some other element or elements such as the other power transmission shafts or a pressure oil pipe mechanism, and in order to repair such broken elements, it cannot be avoided to stop operation of the roller leveler for a long time.

SUMMARY OF THE INVENTION

It is an object of the present invention to provide a power transmission apparatus wherein a universal joint of a power transmission shaft rotated by rotating power is prevented from being broken due to an overload and a torsion detection apparatus for use with the power transmission apparatus which detects a torsion of the power transmission shaft.

In order to attain the object described above, according to an aspect of the present invention, there is provided a power transmission apparatus, comprising a power transmission shaft having a pair of universal joints provided at the opposite ends thereof, and a torsion detection apparatus for detecting a torsion of the power transmission shaft, the torsion detection apparatus including a pair of rotatable members mounted on the power transmission shaft for rotation together with the power transmission shaft, and sensing means or detection means, the rotatable members having at least one pair of opposing portions which are opposed to each other in a spaced relationship from each other around the power transmission shaft, the detection means including a sensor mounted on one of the opposing portions of the rotatable members for detecting an approach of the other opposing portion to the one opposing portion.

Where the power transmission apparatus is applied to a roller leveler or a rolling mill, one of the universal joints is connected to a driving source, and the other universal joint is connected to a work roll of the roller leveler or the rolling mill.

According to another aspect of the present invention, there is provided a torsion detection apparatus for detecting a torsion of a power transmission shaft which has a pair of universal joints provided at the opposite ends thereof, comprising a pair of rotatable members mounted on the power transmission shaft for rotation together with the power transmission shaft, and detection means, the rotatable members having at least one pair of opposing portions which are opposed to each other in a spaced relationship from each other around the power transmission shaft, the detection means including a sensor mounted on one of the opposing portions of the rotatable members for detecting an approach of the other opposing portion to the one opposing portion.

The torsion detection apparatus may be constructed such that the rotatable members are formed from pipes which coaxially surround the power transmission shaft, and the opposing portions are provided at end portions of the pipes, or such that each of the rotatable members is formed from a pipe which coaxially surrounds the power transmission shaft and a plate member extending in a radial direction from the pipe, and the opposing portions are provided at end portions of the plate members. Or, the rotatable members may have a plurality of sets of opposing portions which are spaced from each other by different distances between the sets.

Or else, the torsion detection apparatus may be constructed such that the sensor is a limit switch, and the detection means further includes a pair of slip rings mounted at or in the proximity of an end portion of the power transmission shaft for rotation together with the power transmission shaft and electrically connected to the limit switch, and a feed brush and a collection brush individually held in contact with the slip ring.

In the power transmission apparatus and the torsion detection apparatus described above, a rotating force is applied to the power transmission shaft from the driving source, which may include a motor, via one of the universal joints, and then, the rotating power is transmitted from the power transmission apparatus to a driven member, which may be a work roll of a roller leveler, via the other universal joint. Thereupon, a torsion is produced in the power transmission shaft. The torsion of the driving side end portion of the transmission shaft causes a rotating movement of one of the rotatable members which is mounted at the driving side end portion of the transmission shaft and the torsion of the driven side end portion of the transmission shaft causes another rotating movement of the other rotatable member. The amount of the torsion of the power transmission shaft is larger at the driven side end portion than at the driving side end portion. Consequently, the opposing portion of the above-mentioned other rotatable member relatively approaches the opposing portion of the one rotatable member, and the relative approach of the two opposing portions is detected by the sensor. Consequently, if the distance between the opposing portions of the two rotatable members is set to a magnitude which corresponds to a torsion amount of the power transmission shaft corresponding to a maximum load torque which the driven side universal joint can withstand, then by detecting the relative approach of the two opposing portions by means of the sensor, operation of the roller leveler can be stopped to prevent otherwise possible breakage of or damage to the universal joint.

Where the rotatable members are formed from pipes which coaxially surround the power transmission shaft, they exhibit a comparatively small deflection upon rotation of the power transmission shaft, and besides the rate at which they occupy in a space around the power transmission shaft is comparatively low. Therefore, adoption of the pipes is advantageous where a plurality of power transmission shafts are arranged in a spaced relationship by a comparatively small distance from each other.

Where each of the rotatable members is formed from a pipe which coaxially surrounds the power transmission shaft and a plate member extending in a radial direction from the pipe and the opposing portions are provided at end portions of the plate members, the opposing portions can be arranged on a circle having a diameter larger than that of the power transmission shaft. Here, an amount of a torsion of the power transmission shaft on a circle of the comparatively small diameter is outputted as an amount of rotation of the opposing portion of an expanded or amplified magnitude. Accordingly, an amount or an angle of a torsion of the power transmission shaft can be detected readily with a comparatively high degree of accuracy.

Where the rotatable members have a plurality of sets of opposing portions which are spaced from each other by different distances between the sets, the torque to the universal joint on the driven side up to a limit load torque level of the universal joint can be detected stepwise. For the sensor in this instance, a limit switch, a micro switch, a proximity switch or some other switch can be used.

An on-operation of the sensor for which a switch is used can be outputted by means of a pair of slip rings mounted at or in the proximity of an end portion of the power transmission shaft for rotation together with the power transmission shaft and electrically connected to the switch, and a current feed brush and a collector brush individually held in contact with the slip rings.

Where the torsion detection apparatus for a power transmission shaft or the power transmission apparatus according to the present invention is applied to a roller leveler or a rolling mill, the roller leveler or rolling mill can be operated under torque of a maximum load torque level allowable for the universal joint. Consequently, in the roller leveler, a maximum pressing down force can be applied to a strip as a material to be flattened, which is passed along a pass line between upper and lower work roll sets, and accordingly, the strip can be flattened with a possible maximum plastic deformation rate.

Further, depending upon the roller leveler, two or three work rolls which define an entrance of the pass line are not driven to rotate, but the remaining work rolls beginning with the fourth work roll are driven to rotate. In this instance, the entire power of the driving source is applied to the remaining work rolls. Also in this arrangement, the allowable maximum torque applied to the universal joint can be detected. Consequently, the strip flattening operation can be performed without the anxiety of breakage or damage to the universal joint which arises from torque of an excessively high load torque level.

The above and other objects, features and advantages of the present invention will become apparent from the following description and the appended claims, taken in conjunction with the accompanying drawings in which like parts or elements are denoted by like reference characters.

DESCRIPTION OF THE PREFERRED EMBODIMENT

Figure 1:
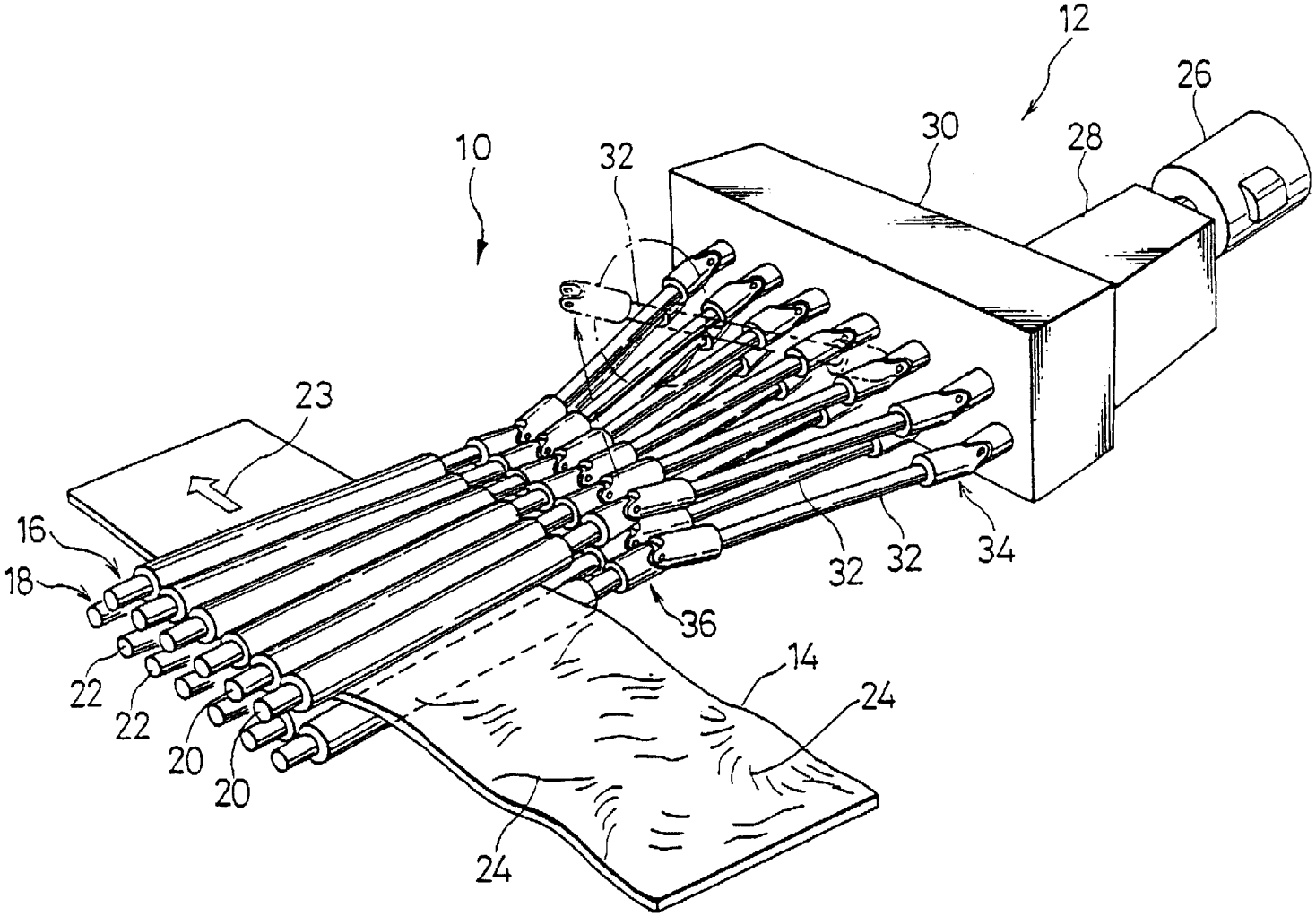
FIG. 1 is a schematic perspective view of part of a roller leveler to which the present invention is applied and a driving mechanism of the roller leveler.

Referring first to FIG. 1, there is shown a driving mechanism 12 of a roller leveler 10 which is an example of a representative application of the present invention.

The roller leveler 10 includes a pair of upper and lower work roll sets 16 and 18 arranged in a zigzag pattern such that they define therebetween a pass line along which a plate material or strip 14 such as a rolled steel plate is passed. The lower work roll set 18 includes a plurality of work rolls 22 which are supported for individual rotation around respective axial lines thereof in parallel to each other on a frame (not shown). Meanwhile, the upper work roll set 16 includes a plurality of work rolls 20 which are supported for individual rotation around respective axial lines thereof in parallel to each other on another fame (not shown). The second-mentioned frame supporting the upper work roll set 16 is supported for upward and downward movement on the first-mentioned frame, on which the lower work roll set 18 is supported, so that the upper work roll set 16 can exert a pressing down force toward the strip 14 on the work roll set 18.

The work rolls 20 and 22 of the work roll sets 16 and 18, receiving power of the driving mechanism 12, are driven to rotate around individual axial lines thereof to provide a feeding force to the strip 14 on the pass line.

While the strip 14 is passed along the pass line and moved in the direction indicated by an arrow 23, it is repetitively bent along the work rolls 20 and 22 under the pressing down force of the upper work roll set 16. Due to the repetitive bends by the work rolls, the opposite surfaces of the strip 14 are extended until the physical property of them enters a plastic region. By such extension, the opposite surfaces of the strip 14 are flattened with strains 24 thereof removed.

Figure 2:
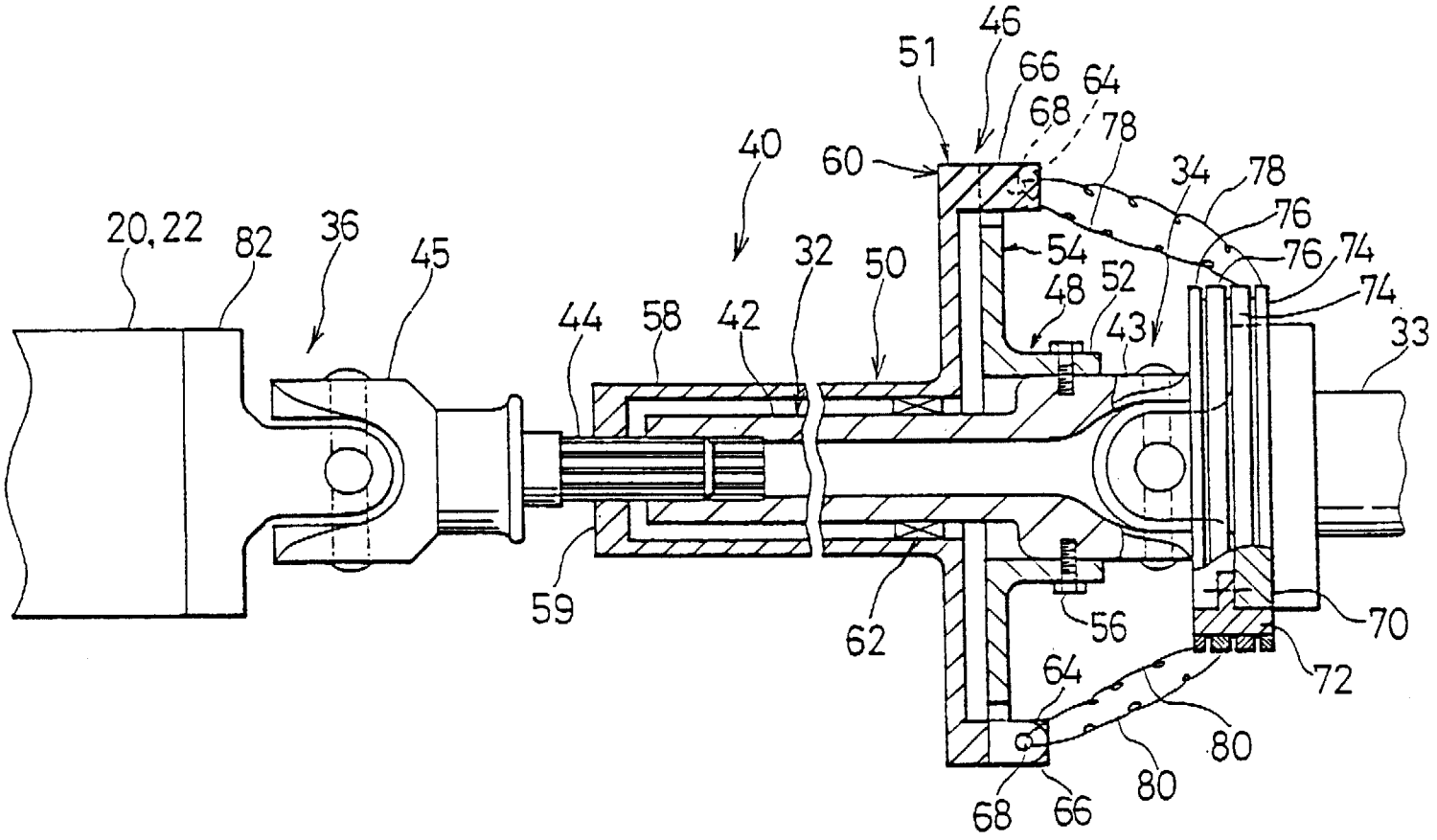
FIG. 2 is a partial enlarged sectional view of the power transmission apparatus.

The driving mechanism 12 includes a driving source including an electric motor 26, a reduction gear 28 connected to the electric motor 26 and a power distributing gear mechanism 30 connected to the reduction gear 28, and a power transmission shafts 32 equal to the work rolls 20 and 22 in its number. Each of the power transmission shafts 32 serves as an element of a power transmission apparatus 40 according to the present invention which will be hereinafter described. The remaining elements of the power transmission apparatus 40 are omitted in FIG. 1 in order to eliminate a complicated illustration, and details of them are shown in FIG. 2.

The power distributing gear mechanism 30 has a drive shafts or output power shafts 33 (refer to FIG. 2) equal to the work rolls 20 and 22 in its number, and each of the power transmission shafts 32 is connected, via a pair of universal joints 34 and 36 provided at the opposite ends thereof, to a corresponding one of the output power shafts 33 of the power distributing gear mechanism 30 and a corresponding one of the work rolls 20 and 22, respectively. Consequently, rotating power of the electric motor 26 is transmitted to the work rolls 20 and 22 via the respective power transmission shafts (intermediate shaft) 32. When the rotating power of the electric motor 26 is received, each of the power transmission shafts 32 undergoes an allowable torsion around the axial line thereof.

By the way, it sometimes occurs that, due to an unexpected excessively high resistance (load) to rotation which is produced with one of the work rolls, in the arrangement shown in FIG. 1, with one of the upper work rolls 20, the universal joint 36 on the driven side connected to an end portion of the work roll 20 is acted upon by a rotating force (torque) which is higher than torque of a designed allowable load level.

With the power transmission apparatus 40 of the present invention, breakage of the universal joint 36 which arises from torque acting upon the universal joint 36 which is higher than the designed allowable load torque level mentioned hereinabove, and more particularly, breakage of a cross-shaped pin of the universal joint 36, and disadvantages originating from the breakage can be prevented. That is, possible damage to adjacent ones of the power transmission shafts on the opposite sides of a corresponding power transmission shaft 32 (indicated in phantom in FIG. 1), which is whirled in a condition disconnected from a corresponding work roll 20, caused by collision of the power transmission shaft 32 with the adjacent power transmission shafts and also to a hydraulic pipe or pipes (not shown) in the proximity of the power transmission shaft, an interruption of operation of the roller leveler 10 which is unavoidable in order to repair the equipments against the damage and a drop in efficiency in flattening operation of the strip 14 by the interruption, can be eliminated.

Referring particularly to FIG. 2, each of such power transmission apparatus 40 includes each of the power transmission shaft 32 shown in FIG. 1 and a pair of universal joints 34 and 36 provided at the opposite ends of the power transmission shaft 32, and a torsion detection apparatus 46 (FIG. 2) for detecting a torsion of the power transmission shaft 32.

As shown in FIG. 2, the power transmission shaft 32 includes a pair of shaft elements 42 and 44 connected to each other for relative movement in an axial direction thereof by spline coupling in order to allow a relative movement of the corresponding work roll 20 or 22 within a permitted range. Further, in the arrangement shown in FIG. 2, a portion of the universal joint 34 on the driving side, that is, a bifurcated portion 43, is formed integrally with an end portion of the shaft element 42, and a portion of the universal joint 36 on the driven side, that is, a bifurcated portion 45, is formed from a member different from the shaft element 44 and is secured to an end portion of the shaft element 44. It can be set arbitrarily whether each of the shaft elements 42 and 44 and the portions (bifurcated portions 43 and 45) of the universal joints are formed integrally with each other or separately from each other. Further, while the shaft element 42 on the driving side is formed from a hollow shaft, it may otherwise be formed from a solid shaft similarly to the shaft element 44 on the driven side.

Figure 3:
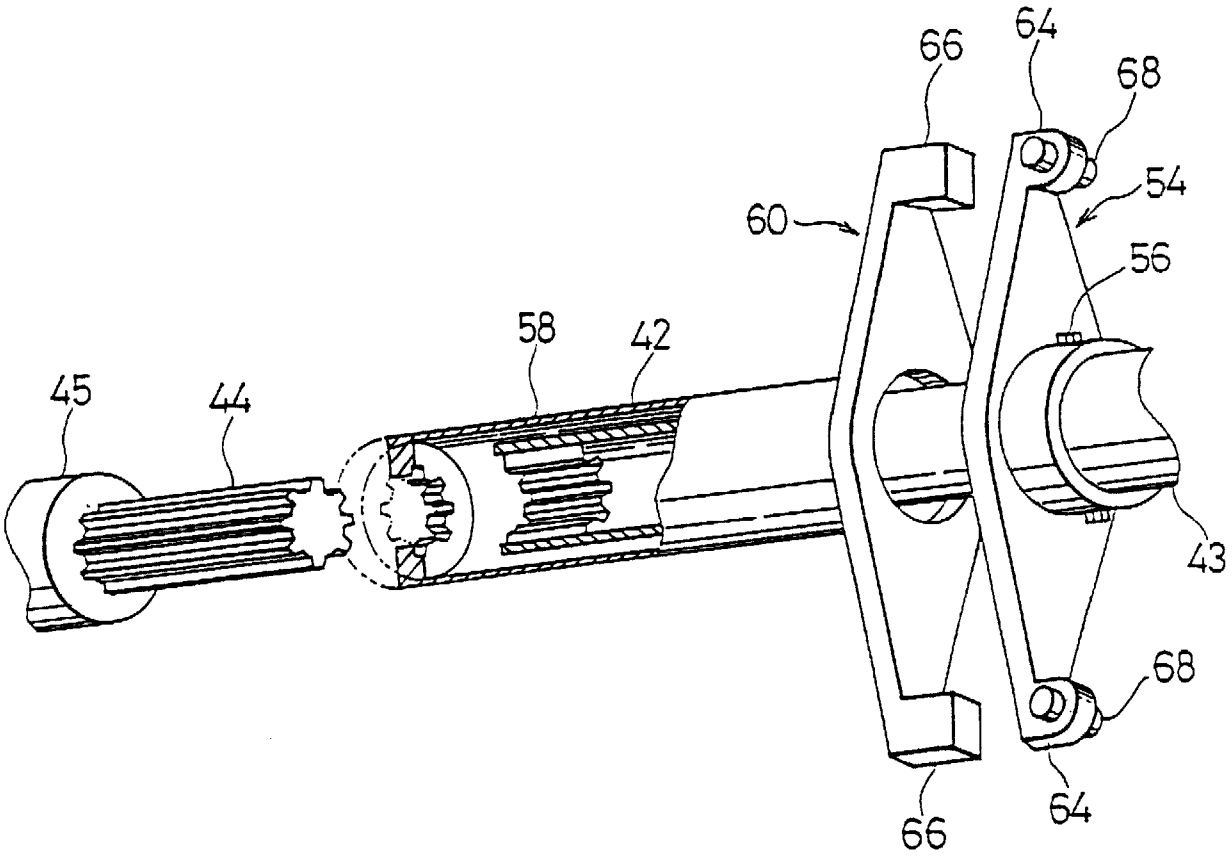
FIG. 3 is an exploded perspective view showing part of the power transmission apparatus.

Referring now to FIGS. 2 and 3, the torsion detection apparatus 46 includes a pair of rotatable members 48 and 50 rotatable together with the power transmission shaft 32, and a detection means.

The rotatable member 48 includes a pipe 52, and a plate member 54 connecting to a driven side end portion of the pipe 52. The pipe 52 coaxially surrounds a portion of the bifurcated portion 43 of the universal joint 34 connecting to the shaft element 42 on the driving side and a portion of the shaft element 42 and is secured to the bifurcated portion 43 by means of a plurality of bolts 56. Consequently, the rotatable member 48 can rotate around its axial line together with the power transmission shaft 32. The rotatable member 48 need not be secured to the bifurcated portion 43 in the proximity of one end portion of the power transmission shaft 32, but may alternatively be secured to the one end portion of the power transmission shaft 32, that is, an end portion of the shaft element 42.

Also the other rotatable member 50 includes a pipe 58, and a plate member 60 connecting to an end portion of the pipe 58 on the driving side. The pipe 58 coaxially surrounds a portion of the power transmission shaft 32, that is, portions of the shaft elements 42 and 44, and is spline engaged at the one end portion thereof with the shaft element 44 of the power transmission shaft 32. Meanwhile, the other end portion of the pipe 58 is opposed to the universal joint 34 on the driving side. A bearing 62 is interposed between the latter end portion of the pipe 58 and the shaft element 42. Consequently, the rotatable member 50 can rotate around its axis together with the power transmission shaft 32. Preferably, the rotatable member 50 is secured, for example, at one end portion thereof, to the shaft element 44 so that it may not be displaced in the axial direction. The rotatable member 50 may alternatively be secured to the bifurcated portion 45 in the proximity of the other end portion of the power transmission shaft 32. Further, the lengthwise dimensions of the pipe 52 and pipe 58 maybe determined optionally only if opposing portions 64 and 66, which will be hereinafter described, are provided thereon, respectively.

When the power transmission shaft 32 receives the rotating power mentioned hereinabove and undergoes a torsion around the axis thereof, the rotatable members 48 and 50 are rotated at the securing locations thereof by torsional angles. The torsional angle at the position on the driven side is larger than that at the position on the driving side. Accordingly, the rotating angle of the rotatable member 50 is larger the rotating angle of the rotatable member 48.

Each of the plate members 54 and 60 of the rotatable members 48 and 50 has a pair of elongated plate portions extending in the opposite directions to each other in radials direction of the power transmission shaft 32. A pair of sets of lug-shaped opposing portions 64 and 66 are provided at the ends of the plate portions of the plate members 54 and 60, respectively, so as to extend in the axial direction of the power transmission shaft 32 and are opposed to each other with a spaced relationship from each other around the power transmission shaft 32.

When the power transmission shaft 32 receives the rotating power and undergoes a torsion and the rotatable members 48 and 50 are rotated in the same direction together with the end portions of the power transmission shaft 32, the distance between the opposing portions 64 and 66 in each set deceases.

One of the opposing portions 64 and 66 in each set, in the arrangement shown in FIG. 3, the opposing portion 64 in each set has a sensor 68 mounted thereon and serving as an element of the detection means mentioned hereinabove for sensing or detecting an approach of the other opposing portion 66 thereto. Each of the sensors 68 is a limit switch. For the sensors 68, a micro switch, a proximity switch or some other switch may be used in place of the limit switch.

The two limit switches are electrically connect via two pairs of conductors 78 and 80, to two pairs of slip rings 74 and 76 mounted on the other bifurcated portion 70 of the universal joint 34 on the driving side with an electric insulator 72 interposed therebetween. A feed brush and a collector brush (not shown) are held in contact with the slip rings in each pair, and an alarming device (not shown) such as, for example, a lamp or buzzer which indicates an on-state of a corresponding one of the limit switches is electrically connected to the two brushes. The slip rings 74 and 76 may alternatively be mounted at the other bifurcated portion 82 of the universal joint 36 on the driven side.

Each of the limit switches exhibits an on-state when the corresponding opposing portion 66 which relatively approaches the corresponding opposing portion 64 presses a contact pin of the limit switch.

The mutual distance between the opposing portions 64 and 66 in a first set, more accurately the distance between the opposing portion 66 and the contact pin of the corresponding limit switch, is set to a magnitude with which, when torque substantially equal to the allowable limit torque level of the universal joint 36 is applied to the power transmission shaft 32, the opposing portion 66 pushes the contact pin of the limit switch to put the limit switch into an on-state. Where the distance is set in this manner, when the limit switch enters an on-state, operation of the roller leveler 10 is temporarily stopped so that breakage of or damage to the universal joint 36 can be prevented. Thereafter, by adjusting the resistances to rotation of the work rolls 20 and 22 of the roller leveler 10, that is, by adjusting the magnitude of the pressing down force of the work roll set 16, operation of the roller leveler 10 can be resumed.

The mutual distance between the opposing portions 64 and 66 in the other or second set is set to such a magnitude that when torque lower than the allowable limit torque level of the universal joint 36 is applied to the power transmission shaft 32, the opposing portion 66 presses the contact pin of the limit switch to put the limit switch into an on-state. When the limit switch between the opposing portions 64 and 66 in the fist set is put into an on-state after the limit switch between the opposing portions 64 and 66 in the second set is put into an on-state, the contact pin of the limit switch for the second set is further pushed in so that the on-state of the limit switch is maintained.

The number of sets of the opposing portions 64 and 66 may otherwise be one, three or more, and if a large number of sets of opposing portions 64 and 66 are provided, then the on-states of the limit switches for the sets can be successively detected to detect a variation in torque applied to the universal joint 36. Further, operation of the roller leveler 10 can be realized in a condition wherein the universal joint 36 is acted upon by torque near to its allowable limit torque level, and consequently, the best flattening effect can be achieved.

Where three or more groups of opposing portions 64 and 66 are provided, the number of elongated plate portions of each of the plate members extending in radial directions set to 3 or more. Or, the plate members may be formed as disks. Since the opposing portions 64 and 66 are provided on the plate members, the opposing portions 64 and 66 are disposed on a circle having a diameter larger than the outer diameters of the pipes 52 and 58. Consequently, the rotation amounts of the pipes 52 and 58 and hence the amount of the torsion of the power transmission shaft 32 are detected as enlarged or amplified amounts at the opposing portions 64 and 66.

The opposing portions 64 and 66 need not be provided on the plate members, but may be provided at end portions of the pipe 52 and pipe 58, respectively. Or else, the opposing portions 64 and 66 may be provided at ends of trumpet-shaped pipe portions provided at the end portions of the pipes 52 and 58 such that each of the pipe portions may have an increasing diameter toward the other pipe portion. Also in those instances, since the ends of the pipes or the pipe portions have an outer diameter larger than the outer diameter of the power transmission shaft 32, an amount of a torsion of the power transmission shaft 32 can be extracted as an expanded or amplified amount.

Figure 4:
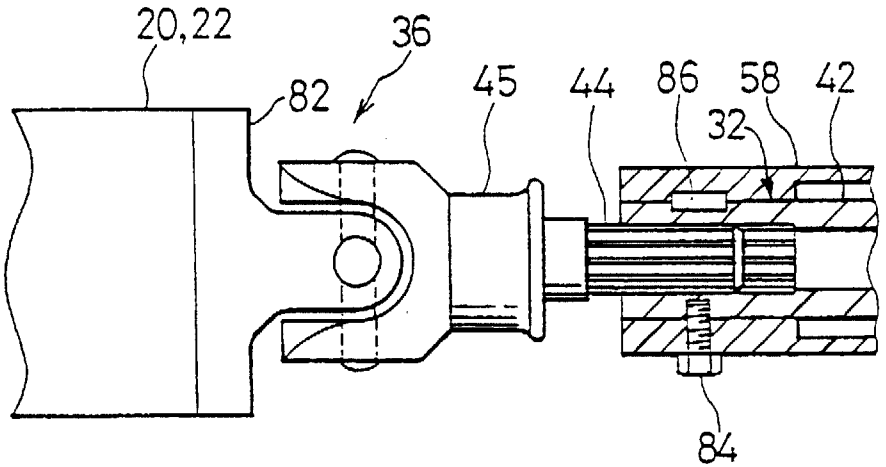
FIG. 4 is a partial sectional view showing an end portion of a power transmission shaft and an end portion of a rotatable member secured to the end portion of the power transmission shaft.

The driven side end portion of the pipe 58 may be secured to the power transmission shaft 32, or more particularly to an end portion of the shaft element 42, as shown in FIG. 4. The end portion of the shaft element 42 is fitted in the driven side end portion of the pipe 58. The end portion of the pipe 58 may be secured to the end portion of the shaft element 42 by means of a plurality of bolts 84. Reference numeral 86 denotes a key disposed to prevent relative rotational movement between the end portions of the pipe 58 and the shaft element 42.

While the present invention is described above in connection with an example of an application thereof to the driving mechanism for the roller leveler 10, the power transmission apparatus or the torsion detection apparatus for a power transmission shaft according to the present invention can be applied to various other mechanisms than the driving mechanism for the roller leveler described above. As another example of an application, the present invention can be applied, for example, to a drive mechanism for a rolling mill.

The invention having now fully described, it will be apparent to one of ordinary skill in the art that many changes and modifications can be made thereto without departing from the spirit and scope of the invention as set forth herein.

What is claimed is:

1. A power transmission apparatus, comprising:

a power transmission shaft having a pair of universal joints provided at opposite ends thereof; and a torsion detection apparatus for detecting a torsion of said power transmission shaft;

said torsion detection apparatus including a pair of rotatable members mounted on said power transmission shaft for rotation together with said power transmission shaft, and detection means;

said rotatable members having at least one pair of opposing portions which are opposed to each other in a spaced relationship from each other around said power transmission shaft;

said detection means including a sensor mounted on one of said opposing portions of said rotatable members for detecting an approach of the other opposing portion to the one opposing portion.

2. A torsion detection apparatus for detecting a torsion of a power transmission shaft which has a pair of universal joints provided at opposite ends thereof, comprising:

a pair of rotatable members mounted on said power transmission shaft for rotation together with said power transmission shaft; and detection means;

said rotatable members having at least one pair of opposing portions which are opposed to each other in a spaced relationship from each other around said power transmission shaft;

said detection means including a sensor mounted on one of said opposing portions of said rotatable members for detecting an approach of the other opposing portion to the one opposing portion.

3. A torsion detection apparatus according to claim 2, wherein said rotatable members have a plurality of sets of opposing portions which are spaced from each other by different distances between the sets.

4. A torsion detection apparatus according to claim 2, wherein said rotatable members are formed from pipes which coaxially surround said power transmission shaft, and said opposing portions are provided at end portions of said pipes.

5. A torsion detection apparatus awarding to claim 2, wherein each of said rotatable members is formed from a pipe which coaxially surrounds said power transmission shaft and a plate member extending in a radial direction from said pipe, and said opposing portions are provided at end portions of the plate members.

6. A torsion detection apparatus according to claim 2, wherein said sensor is a limit switch, and said detection means further includes a pair of slip rings mounted at or in the proximity of an end portion of said power transmission shaft for rotation together with said power transmission shaft and electrically connected to said limit switch, and a feed brush and a collection brush individually held in contact with said slip ring.

7. A power transmission apparatus according to claim 1, wherein one of said universal joints is connected to a driving source and the other universal joint is connected to a work roll of a roller leveler.

8. A power transmission apparatus according to claim 1, wherein one of said universal joints is connected to a driving source and the other universal joint is connected to a work roll of a rolling mill.

* * * * *